US006938673B1

(12) United States Patent
McKibben et al.

(10) Patent No.: US 6,938,673 B1
(45) Date of Patent: Sep. 6, 2005

(54) SAFETY BLOCK DEVICE FOR USE IN A PRESS DEVICE

(75) Inventors: Kenneth D. McKibben, Defiance, OH (US); Daniel D. Minor, Cadillac, MI (US); Mark Salgat, Pinconning, MI (US); Robert L. Macheske, Tawas City, MI (US); Michael A. Coffman, Milford, MI (US); Aleksander A. Filipov, Au Gres, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 87 days.

(21) Appl. No.: 10/626,511

(22) Filed: Jul. 24, 2003

(51) Int. Cl.[7] ..... B22D 33/04
(52) U.S. Cl. ..... 164/341; 164/306; 100/341
(58) Field of Search ..... 164/341, 306, 164/137; 100/341

(56) References Cited

U.S. PATENT DOCUMENTS

| | | | | |
|---|---|---|---|---|
| 2,653,560 | A | | 9/1953 | Bradhering |
| 3,855,920 | A | | 12/1974 | Wright |
| 3,855,921 | A | | 12/1974 | Wright |
| 4,269,259 | A | | 5/1981 | Ueno et al. |
| 4,287,935 | A | | 9/1981 | Ueno et al. |
| 4,598,574 | A | | 7/1986 | Hegel et al. |
| 4,754,801 | A | | 7/1988 | Ueno et al. |
| 4,861,259 | A | | 8/1989 | Takada |
| 4,993,474 | A | | 2/1991 | Uchida |
| 5,429,175 | A | | 7/1995 | Thieman et al. |
| 5,533,564 | A | | 7/1996 | Alberola et al. |
| 5,598,882 | A | * | 2/1997 | Merrill ..... 164/306 |
| 5,601,135 | A | | 2/1997 | Merrill |
| 5,660,223 | A | | 8/1997 | Thieman et al. |
| 5,671,799 | A | | 9/1997 | Merrill |
| 5,861,181 | A | * | 1/1999 | Thomas et al. ..... 425/188 |
| 6,089,148 | A | * | 7/2000 | Bloomer ..... 100/341 |
| 6,192,971 | B1 | | 2/2001 | Girardin et al. |
| 6,293,759 | B1 | | 9/2001 | Thut |

* cited by examiner

*Primary Examiner*—Kevin Kerns
*Assistant Examiner*—I.-H. Lin
(74) *Attorney, Agent, or Firm*—MacMillan, Sobanski & Todd, LLC

(57) ABSTRACT

A safety block device for supporting a generally vertically movable component about a guide post of a press device. According to one embodiment of the invention, the safety block device includes a generally upright column (42) adapted to be disposed adjacent the guide post (18) and moveable between a retracted non-working position, wherein the column does not support the moveable component, and an extended working position, wherein the column is effective to support the moveable component and prevent movement thereof. The column includes an upper end portion and a lower end portion. According to one feature of the invention, the lower end portion of the column includes a generally rounded first portion (62*a*) and a generally second flat portion (62*b*) which is slightly offset with respect to the first portion. As a result of this, when the safety block device is in the extended working position, the generally flat second portion of the lower end portion of the column rests firmly on an underlying surface of either the safety block device or the press device.

19 Claims, 13 Drawing Sheets

SAFETY BLOCK DEVICE FOR USE IN A PRESS DEVICE

TECHNICAL FIELD

This invention relates in general to press devices and in particular to a safety block device for use with such a press device.

BACKGROUND OF THE INVENTION

Press devices are machines that typically have vertically moving components generally activated by a ram actuator. Examples of press devices include stamping presses, printing presses, screening presses, and mold casting assemblies.

A typical mold casting assembly is used to create a particular shaped component from molten materials such as plastics or metal. In the metallurgy industry, low pressure mold casting involves the injection of a molten metal into a casting machine typically having a two-piece mold. The mold casting machine can be supported on a carriage so it can be moved to and away from a crucible containing the molten metal. The casting machine may be moved during changing of the casting mold or during servicing of the furnace. Each casting mold is comprised of an upper mold half called the cope and a lower mold half called the drag. The drag and cope are usually constructed of iron, H-13 tool steel or similar metals if casting is performed using metals with a relatively low melting point such as aluminum, zinc, magnesium, copper, lead, and their respective alloys.

Typically, a casting mold is installed onto the casting machine by first placing the mold onto a vertically moveable upper plate called the platen. The drag and cope are kept banded together until the cope can be attached to the platen. After the cope is secured to the movable platen, the movable platen is lowered to rest the drag upon a base plate of the casting machine. The banding about the cope and drag is then removed and the drag is secured to the base plate. Thereafter the mold cavity defined by the cope and drag is opened and closed during casting cycles and the molten metal from the crucible is supplied into the mold cavity during each casting cycle. The molten metal is allowed to cool within the mold cavity before the mold is opened and the casting is removed. Sometimes a special ejector device is used to remove the castings from the mold since the castings often stick to the mold halves.

When the cope is suspended in the open position on the moving platen of the casting machine, there exists a significant amount of potential energy stored in the suspended components and the associated hydraulic cylinders of the machine. Because of this, it is known to use safety die blocks to support and lock the position of the movable platen to prevent movement thereof and maintain the machine in a zero mechanical state, commonly referred to as ZMS. Adjustable jack-type safety die blocks are well known in the art for this purpose and one type of such a safety block is described in U.S. Pat. No. 2,653,560 to Bradhering. However, adjustable jack-type safety blocks are time-consuming to install and can interfere with working space during cleaning or maintenance of the machines. An example of a more automated ratchet-type of safety block device is shown in FIG. 17 of U.S. Pat. No. 5,598,882 to Merrill.

SUMMARY OF THE INVENTION

This invention relates to a safety block device for supporting a generally vertically movable component about a guide post of a press device. According to one embodiment of the invention, the safety block device includes a generally upright column adapted to be disposed adjacent the guide post and moveable between a retracted non-working position, wherein the column does not support the moveable component, and an extended working position, wherein the column is effective to support the moveable component and prevent movement thereof. The column includes an upper end portion and a lower end portion. According to one feature of the invention, the lower end portion of the column includes a generally rounded first portion and a generally second flat portion which is slightly offset with respect to the first portion. As a result of this, when the safety block device is in the extended working position, the generally flat second portion of the lower end portion of the column rests firmly on an underlying surface of either the safety block device or the press device.

Other advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
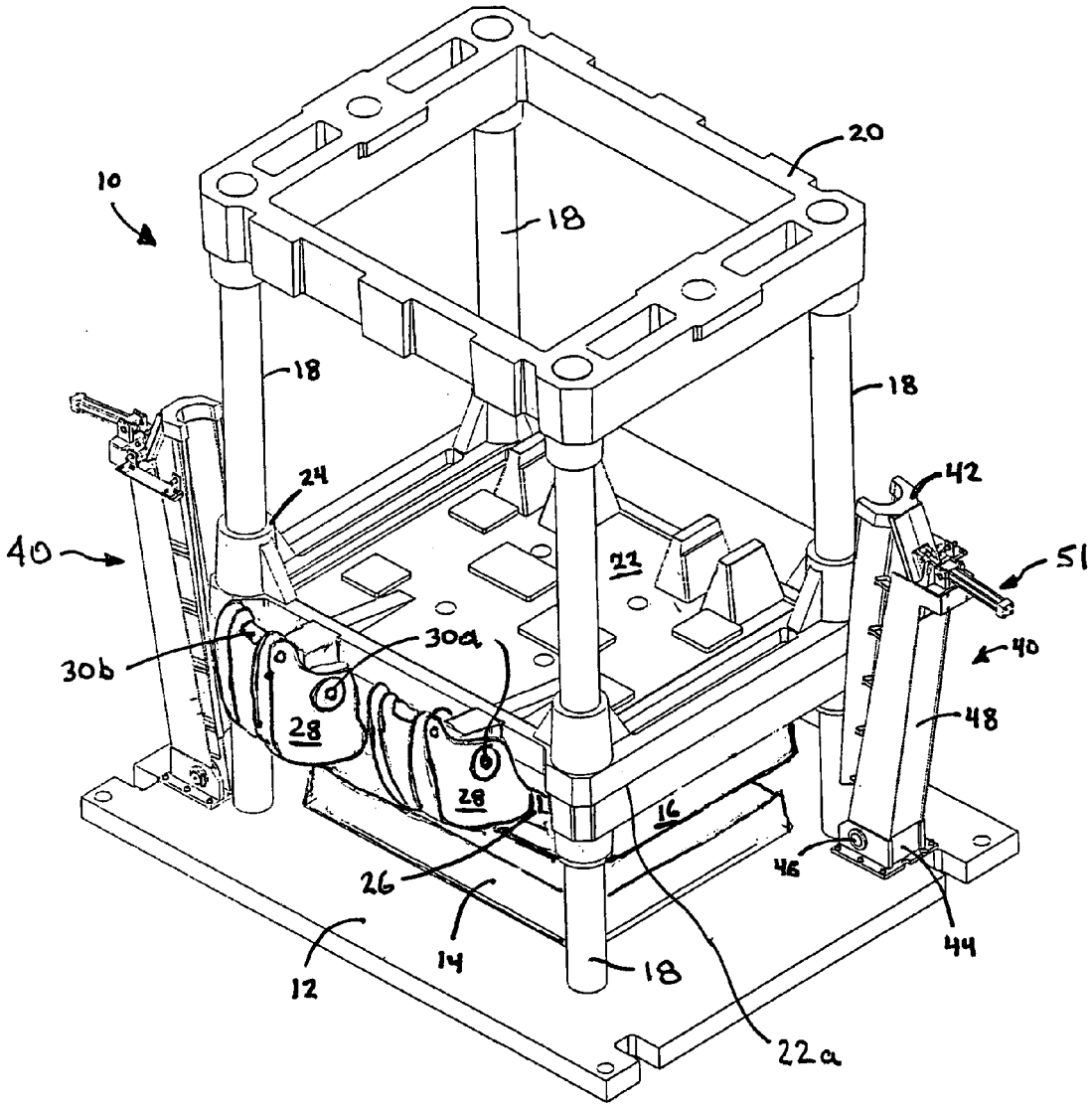
FIG. 1 is a perspective view of casting apparatus having a die casting apparatus having a first embodiment of a safety block device in accordance with the invention, the safety block device being illustrated in a non-working position.

Referring now to the drawings, there is illustrated in FIG. 1 a die casting apparatus, indicated generally at 10, including a first embodiment of a safety block device, indicated generally at 40 and constructed in accordance with the present invention. The general structure and operation of the die casting apparatus 10 is conventional in the art. Thus, only those portions of the die casting apparatus 10 which are necessary for a full understanding of this invention will be explained and illustrated. While the present invention will be described and illustrated in connection with the particular die casting apparatus 10 disclosed herein, it is understood that the invention can be used in connection with other kinds of die casting and press type apparatuses if so desired. For example, the present invention can be used in connection with the casting apparatuses disclosed in U.S. Pat. No. 5,671,799 to Merrill, U.S. Pat. No. 5,601,135 to Merrill and U.S. Pat. No. 5,598,882 to Merrill, the disclosures of each of these patents incorporated herein. The present invention can also be used in connection with any type of device, machine or apparatus having at least one moveable member, horizontally, vertically or otherwise, which is held or maintained separate or spaced apart from another member, which can be fixed or moveable. As used herein, the term "press device" will be used to designate all of these types of devices, machines or apparatuses.

In the illustrated embodiment, the die casting apparatus 10 is a low pressure type of casting machine and is positioned over a furnace (not shown) and crucible (not shown) holding molten metal. The die casting apparatus 10 includes a base plate or bed 12 for supporting a lower mold half (the drag) 14 above the molten metal bath. An upper mold half (the cope) 16 is supported above the drag 14. Together, the cope 16 and drag 14 define a mold cavity for receiving the molten metal and molding the metal into a desired shape. As is well known in the art, one or more riser stalks (not shown) extend downwardly from the drag 14 and into the molten metal bath for conveying the molten metal up and into the cavity of the mold. A vacuum is applied to the mold cavity and/or an inert gas or dry air applies a positive pressure to the molten metal bath thereby forcing the molten metal to flow up through the riser stalk and into the mold cavity.

A plurality of guide posts 18, four in total, extend upwardly from the base plate 12 and define an operating area therebetween. The bottoms of the guide posts 18 are secured to the base plate 12 by collar and threaded fastener assemblies or by other conventional means known in the art. A fixed platen or crown 20 is supported by the guide posts 18 in a fixed vertical spacing above the base plate 12. The fixed platen 20 is secured to the tops of the guide posts 18 by a plurality of collar and threaded fastener assemblies or other conventional means known in the art. The vertical distance between the base plate 12 and the fixed platen 20 is therefore constant or fixed.

A movable platen 22 is guided for vertical movement by the guide posts 18 in the operating area by and between the guide posts 18. A bearing sleeve 24, integral with the movable platen 22, surrounds each guide post 18. A pair of ram actuators (not shown) or other means of movement interconnects the fixed platen 20 and the movable platen 22 for moving the movable platen 22 vertically on the guide posts 18 relative to the fixed platen 20. The moveable platen 22 includes a lower surface 22*a*.

A tilt plate 26 is operatively connected to the movable platen 22 by one or more crank arms 28. The cranks arms 28 are integral with or fixed to and extend laterally outwardly and upwardly from one lateral edge of the tilt plate 26. Pivot pins 30*a* are aligned axially with one another to define a pivotal joint on a tilt axis between the movable platen 22 and the tilt plate 26 for rotating the crank arms 28 and the tilt plate 26 as a unit relative to the movable platen 22 about the tilt axis defined by the pivot pins 30*a*. To accomplish this rotary or pivotal movement, the distal ends of the crank arms 28 include a second set of pivot pins 30*b* for attaching the crank arms 28 to a hydraulic cylinder (not shown).

As the tilt plate 26 swings outward from the movable platen 22 and laterally from the guide posts 18, the downwardly facing attachment surface of the tilt plate 26 folds into a loading position for supporting the cope 16 of the mold under the movable platen 22. In this position, the attachment surface faces sufficiently upwardly to allow the cope 16 and drag 14 defining the mold to rest thereon under the force of gravity as the mold is attached to the movable platen 22 by clamps (not shown) or other conventional means known in the art. When the mold is to be loaded onto the tilt plate 26, the cope 16 and drag 14 are banded together so as to be movable as a unit and so that the clamping of the cope 16 in place on the tilt plate 26 will also hold the drag 14 thereto. Devices which may be used as cope clamps are available from GS CLAMPS as model GS0630. When the cope clamps are secured, the mold is rotated from the loading position (not shown) to an operating position (as shown in FIG. 1), and the tilt plate 26 is locked to the movable platen 22 by support locks (not shown). The structure and operation of the die casting apparatus 10 thus far described is conventional in the art.

Referring now to FIG. 1, there is illustrated a first embodiment of a safety block device, indicated generally at 40, in accordance with this invention. As will be discussed below, the safety block device 40 is operative to positively secure the movable platen 22 shown in the die casting apparatus in FIG. 1 in a fixed predetermined position, and other vertically movable components in similar press devices, when desired such as for example, when operators are cleaning, dislodging castings from dies, inspecting or performing maintenance on such press devices. Although FIG. 1 shows the safety block device 40 of the invention in reference to a generally vertical die casting apparatus 10, it should be clear to those skilled in the art that this invention can be used with any type of a press device at that term is defined herein and is not limited to casting applications.

The safety block device 40 includes a generally upright U-shaped column 42 that is movably secured to a base 44 by appropriate means. The column 42 is pivotally connected to the base 44 by a pivot pin 46. As will be discussed below in detail, the column 42 is selectively moveable between a non-actuated or retracted non-working position shown in FIGS. 1 and 2, wherein the column 42 is spaced from engagement with the associated guide post 18 to allow movement of the moveable platen 22 between a raised non-working position (not shown) and a lowered working position shown in FIG. 1, and an actuated or extended working position shown in FIG. 3, wherein the column 42 engages the associated guide post 18 to prevent movement of the moveable platen 22 when it is in its raised non-working position.

Figure 2:
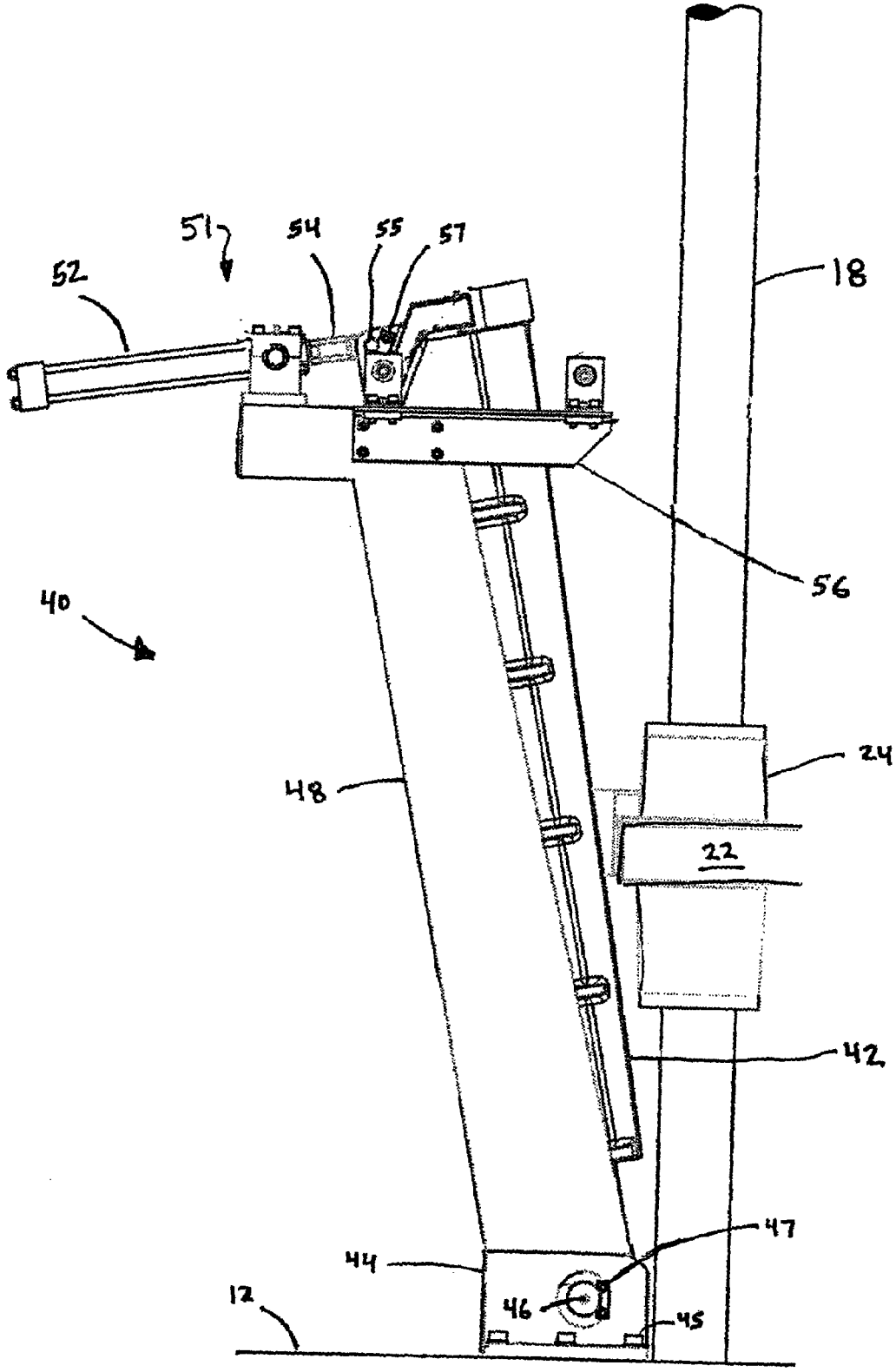
FIG. 2 is an enlarged side elevational view of the safety block device illustrated in FIG. 1.

FIG. 2 shows a pair of safety block devices 40 in accordance with the invention while the devices 40 are in the retracted non-working position. The structure of the devices 40 are identical although they need not be. In the illustrated embodiment, the pair of die safety devices 40 are preferably provided adjacent a pair of opposed or non-adjacent guide posts 18. Preferably, at least a pair of die block safety devices 40 are used in connection with the die casting apparatus 10. However, the number of die block safety devices 40 can be other than illustrated if so desired. For example, the die casting apparatus 10 could include only a single die block safety device 40 or could include more than two die block safety devices 40 if so desired.

Each of the safety block devices 40 is secured to the base plate 12 of the die casting apparatus 10 by a plurality of threaded fasteners 45 or other suitable means immediately adjacent the associated guide post 18. Preferably, the U-shaped column 42 has an inner radius of curvature slightly larger than an outer diameter of the guide post 18 so the column 42 can be secured around the guide post 18.

As best shown in FIG. 2, the column 42 is movably secured to the base 12 by the pivot pin 46 so that the column 42 can be pivoted out of the way from engagement with the movable platen 22 when the die casting apparatus 10 is in operation. When the column 42 is pivoted away from the guide post 18 on the pivot pin 46, it may simply be rested on the floor away from the guide post 18, or it may sit in an optional but preferred column support 48. The column support 48 is provided in the preferred design to hold the column 42 in a partially vertical position when it is in the retracted non-working position shown in FIG. 2. Preferably, the column support 48 is firmly affixed to the base 44 in a non-movable fashion, as will be discussed below. Alternatively, the column support 48 may be affixed to the base plate 12 if so desired.

Figure 4A:
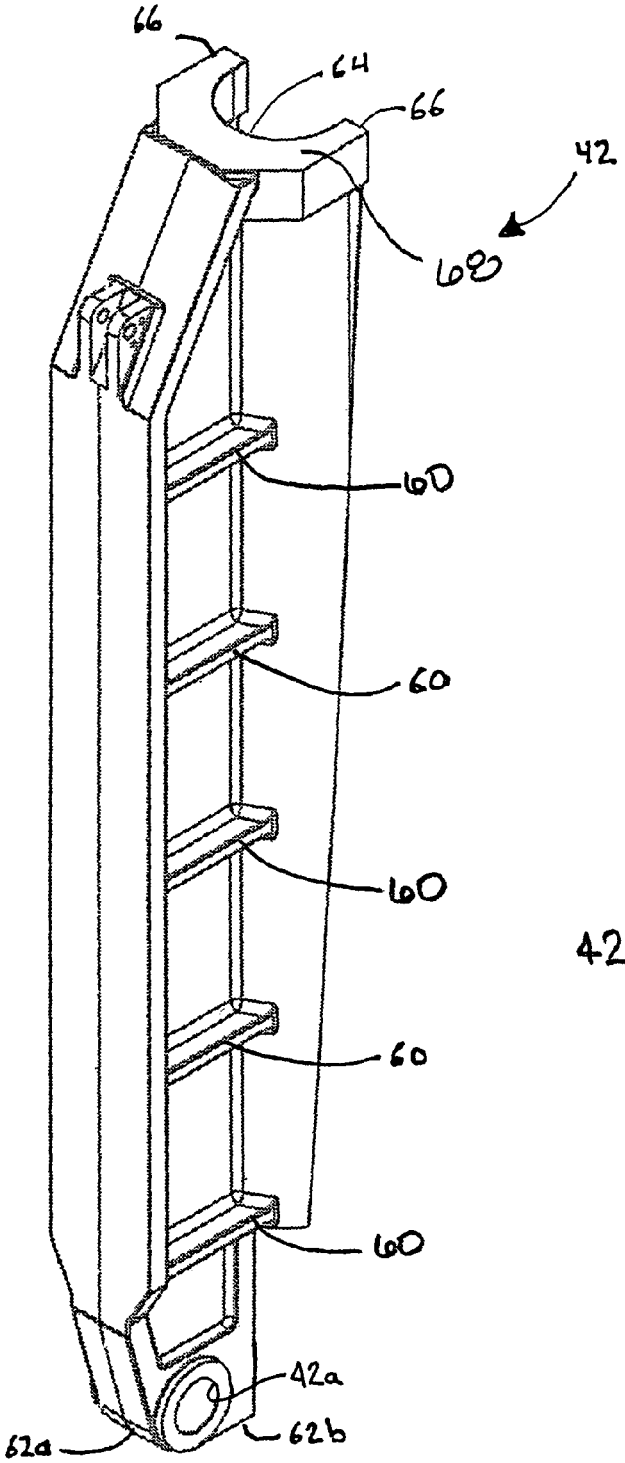
FIG. 4A is an enlarged perspective view of a portion of the safety block device illustrated in FIG. 1.
Figure 4B:
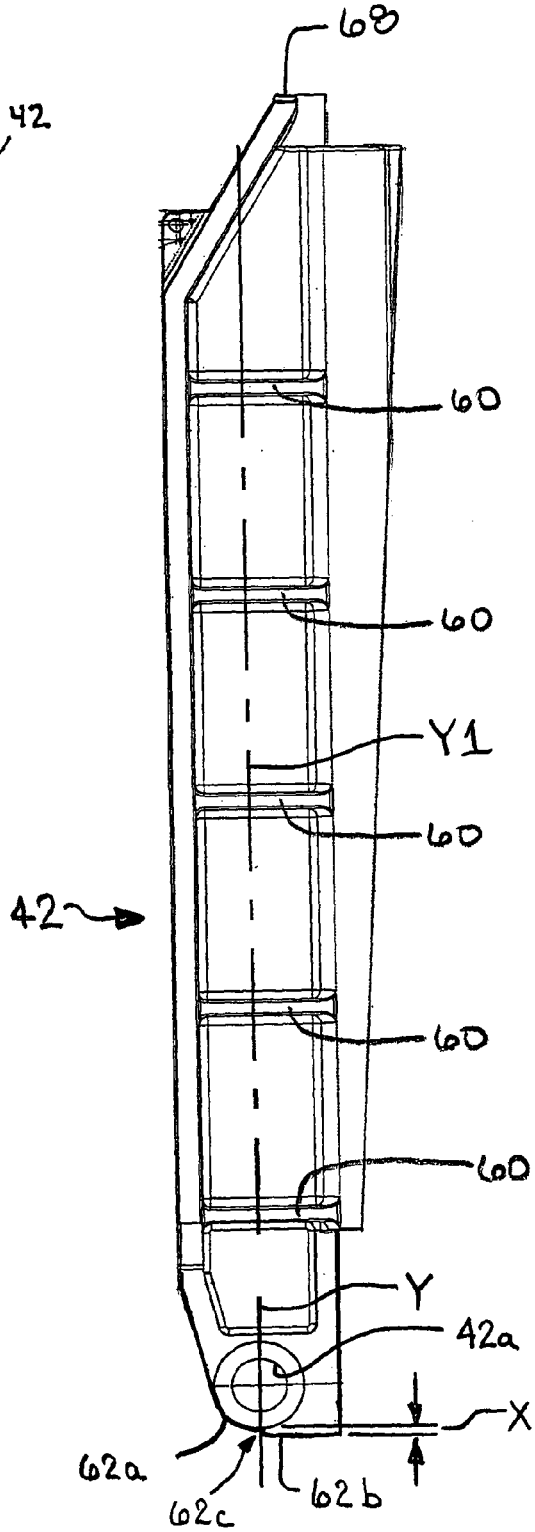
FIG. 4B is an enlarged side view of a portion of the safety block device illustrated in FIG. 1.
Figure 4D:
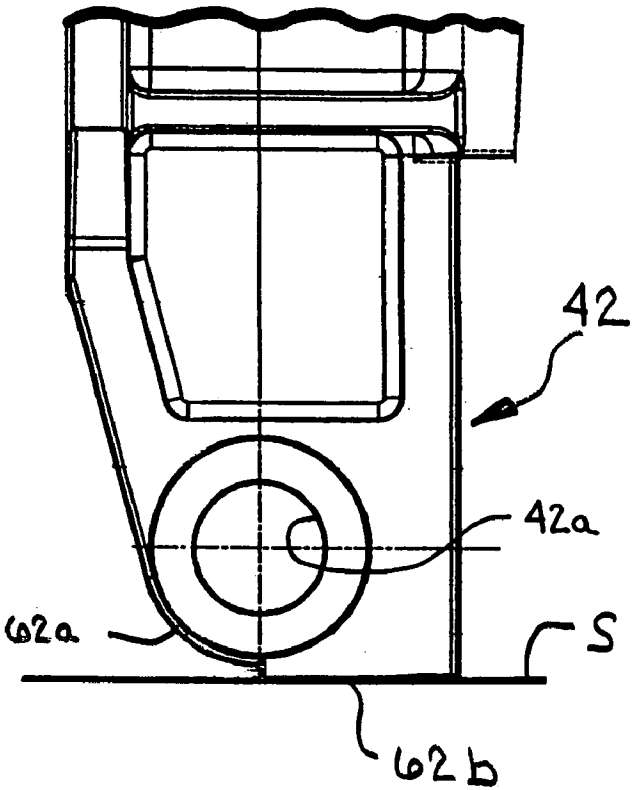
FIG. 4D is an enlarged side view of a portion of the safety block device in accordance with this invention, the safety block device being illustrated in a working position.
Figure 4C:
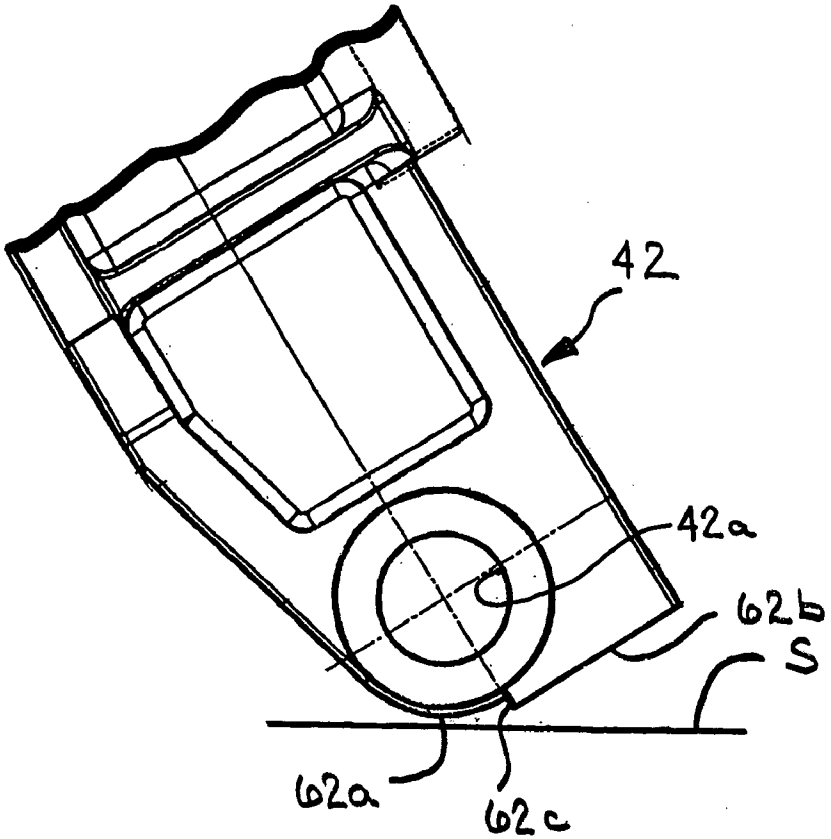
FIG. 4C is an enlarged side view of a portion of the safety block device in accordance with this invention, the safety block device being illustrated in a non-working position.
Figure 4E:
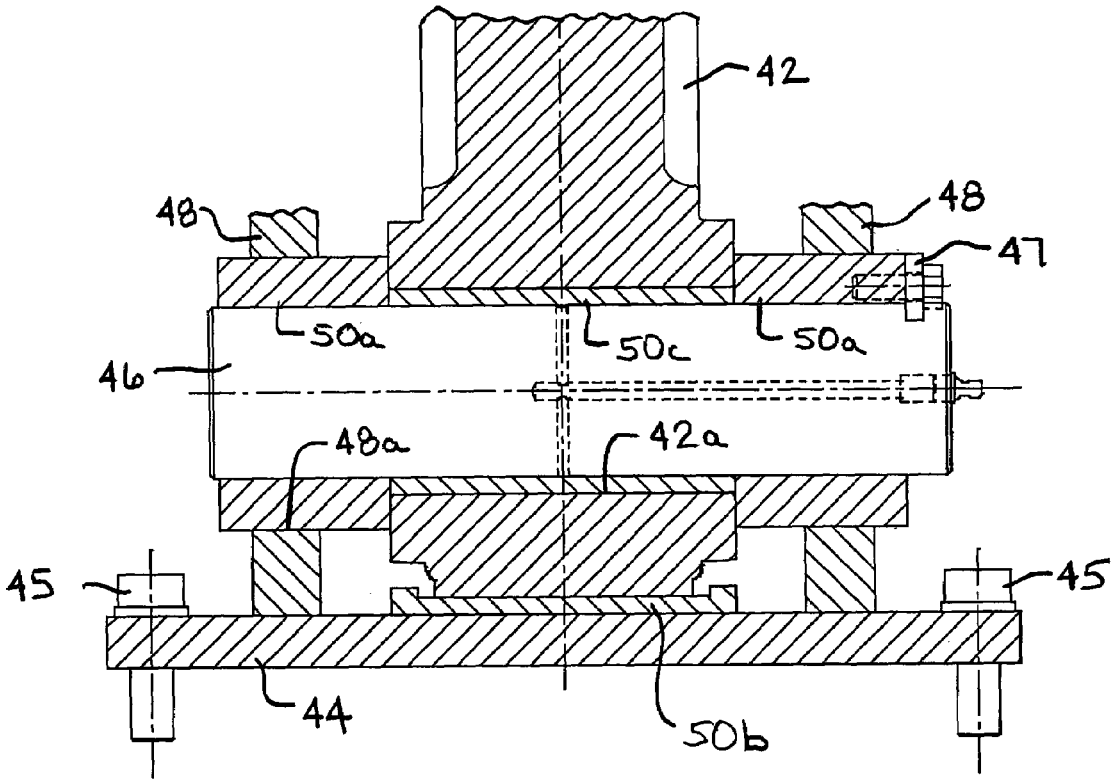
FIG. 4E is an enlarged sectional view of a portion of the safety block device in accordance with this invention.

As best shown in FIG. 4E, the pivot pin 46 is disposed in and extends through aligned bores 48*a* and 42*a* located in the lower portion of the column support 48 and the U-shaped column 42, respectively, to pivotally support the U-shaped column 42 relative to the guide post 18. A keeper 47 is provided at at least one of the opposed ends of the pivot pin 46 to secure the pivot pin 46 in place. As shown in FIG. 4E, preferably a weldment consisting of the column support 48, the base 44, a pair of sleeves or bushings 50*a* disposed in the bore 48*a* of the column 48, and a base plate 50*b* is provided for pivotally supporting the U-shaped column 42. The sleeves 50*a* are provided with an inner diameter slightly greater than an outer diameter of the pivot pin 46 so as to closely receive and support the pivot pin 46 therein. Also, a sleeve or bushing 50*c* is provided in the bore 42*a* of the column 42. Preferably, the sleeve 50*c* is provided with a clearance of around 0.001 inches per 1 inch diameter of the pin 46. Thus, it can be understood that the pivot pin 46 is primarily supported by the bushings 50*a*. Preferably, in the illustrated embodiment, the column 42 is formed from A535 aluminum; the support column 48, the base 44, the base plate 50*b* and the bushings 50*a* are formed from 1020 hot rolled steel; the pivot pin 46 has a diameter of about 2.5 inches and is formed from 1018 cold rolled steel, 1045 mild steel or is induction hardened chrome plated; and the bushing 50*c* is formed from bronze. Alternatively, other methods can be used to pivotally support the U-shaped column 42 with respect to the die casting apparatus 10 if so desired and/or the above described components can be formed from other materials than those discussed above if so desired.

Preferably, the column support 48 is provided to support an actuation device, indicated generally at 51 in an automated embodiment of the invention. Although the U-shaped column 42 may be manually transferred between the retracted non-working position and the extended working position by hand, the preferred embodiment includes the actuation device 51 in order to automatically perform this movement. The actuation device 51 is secured to the column support 48 and operated by suitable means, such as for example, by hydraulics, pneumatics or electromagnetics. The actuation device 51 includes an actuation cylinder 52 having a movable rod 54 that telescopically extends and retracts from the cylinder 52. The distal end of the movable rod 54 is secured to the U-shaped column 42 by a pivot pin 55 and keeper 57. Therefore, as the movable rod 54 extends telescopically outward from the cylinder 52, the U-shaped column 42 pivots at the pivot pin 46 moving the U-shaped column 42 to the vertical position shown in FIG. 3. In this position, the column 42 partly encircles or surrounds the guide rod 18 and therefore prevents movement of the moveable platen 22 from its raised position.

In the preferred embodiment, a bracket 56 is secured adjacent to the column support 48. The bracket 56 provides lateral support to prevent the movable rod 54 from bending, swaying or deforming under an unanticipated non-axial load, but also serves as a mounting surface for automated controls such as for example, sensing devices that determine when the movable platen 22 is retracted or extended. In the illustrated embodiment, the cylinder 52 preferably includes a limit switch (not shown) and the bracket 56 preferably includes a pair of limit switches (not shown). These limit switches for a redundant electrical circuit to identify the position of the safety block device 40 between the retracted, non-working position and the extended working position. Alternatively, other methods can be used to determine the position of the safety block device 40 if so desired.

The illustrated preferred embodiment of the U-shaped column 42 of the safety block device 40 of this invention is best viewed in FIGS. 4A and 4B and has several unique features in accordance with this invention and which allow it to serve under heavy loads in a large press device. First, the column 42 includes a plurality of reinforcement bars or ribs 60 which are operative to absorb forces and prevent buckling during eccentric loading of the column 42. In addition, a lower or bottom portion of the column 42 is created with a cam like mechanism. To accomplish this in the illustrated embodiment, the bottom portion of the column 42 has a generally rounded first portion 62*a* and a generally second flat portion 62*b* which is slightly offset or spaced apart a distance X with respect to the first portion 62*a* by a step, indicated generally at 62*c*. As shown in FIG. 4*b*, in the illustrated embodiment the step 62*c* preferably extends coaxially along a vertical axis Y of the bore 42*a* of the column 42. Thus, as shown in FIG. 4D, when the safety block device 40 is in the extended working position to support the movable platen 22 in its raised position and prevent the movement thereof, the generally flat second portion 62*b* of the column 42 rests firmly on an underlying surface S, which may be either the base plate 12 of the casting assembly 10 or the base 44 or 50*b* of the device 40. Thus, the load on the column 42 is transferred directly to the base 44 or 50*b* or base plate 12 via the second portion 62*b* of the column, thereby relieving strain which would otherwise be transferred to the pivot pin 46. However, as the column 42 pivots into the retracted non-working, the generally rounded first end 62*a* and the step 62*c* function to allow the column 42 to move freely without any part of the bottom portion of the column 42 engaging or locking with the underlying surface S of either the base plate 12 or the base 44 or 50*b*, as shown in FIG. 4C.

Figure 3:
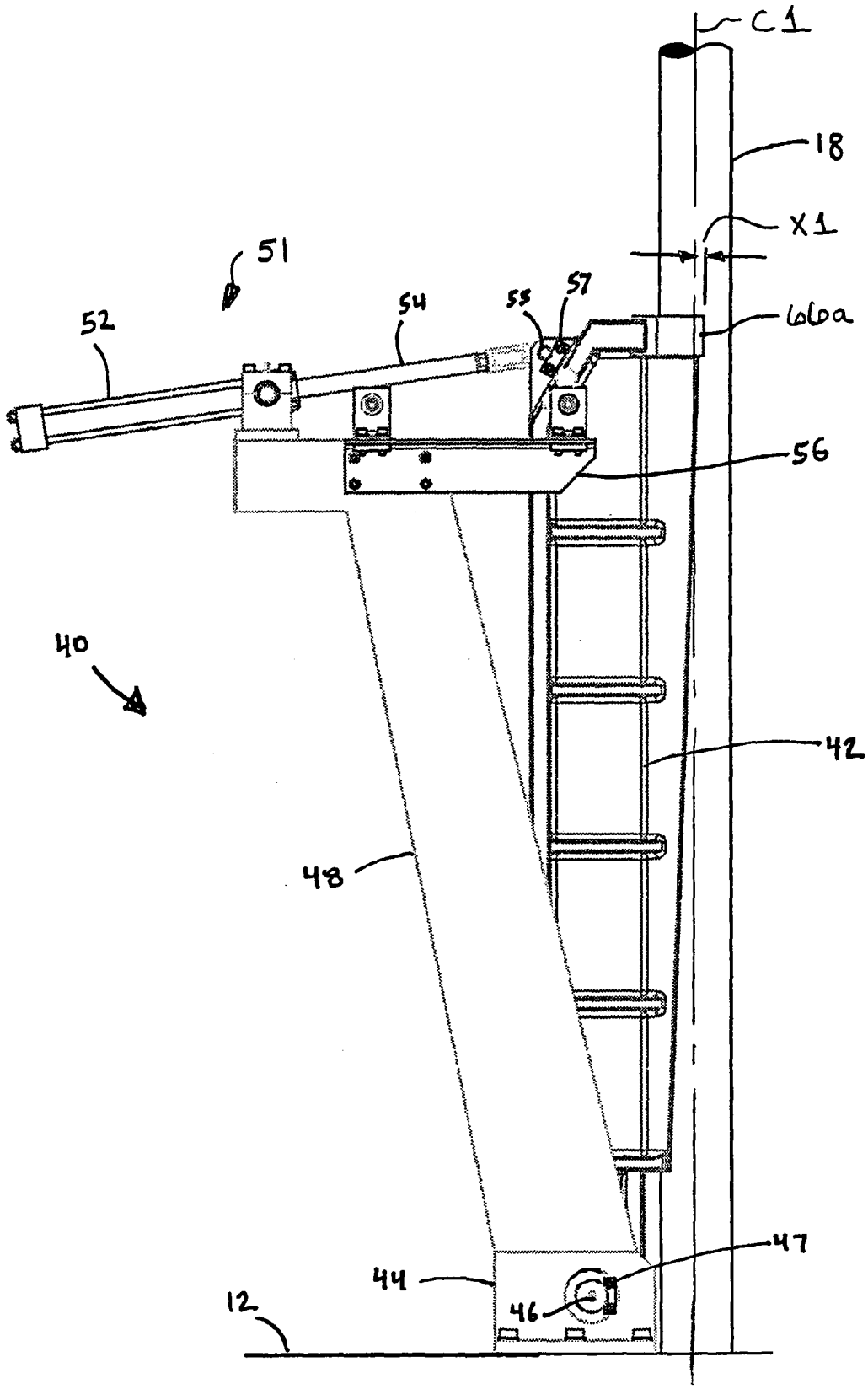
FIG. 3 is an enlarged side elevation view of the safety block device in accordance with the invention, the safety block device being in working position.

Another unique feature of the safety block device 40 of this invention is in the design of the U-shaped channel 64 of the column 42. The channel 64 includes two uppermost legs 66 which are preferably designed to be longer than an associated radius of the guide posts 18 of the die casting apparatus 10. As a result of this, an outermost end 66*a* of the legs 66 will extend past a center-line C1 of the guide post 18 a distance X1 when the device 40 is in the extended working position, as shown in FIG. 3. This allows the load from the movable platen 22 to be distributed more evenly along an axis Y1 (shown in FIG. 4B), of the U-shaped column 42 to minimize the eccentric loading of the column 42. Also, the column 42 is operatively locked into the extended working position by comparing a radius extending from the pivot pin 46 to the outermost end 66*a* of the legs 66. In the embodiment illustrated in FIG. 4B, the axis Y1 of the column and the vertical axis Y of the bore 42*a* are the same. The channel 64 also includes a generally flat upper surface 68. The upper surface 68 is adapted to be disposed directly adjacent the lower surface 22*a* of the moveable platen 22 when the device 40 is in the extended working position to thereby support and lock the moveable platen 22 and prevent movement thereof when it is in the raised position. Alternatively, the structure of the column 42 can be other than illustrated if so desired. For example, the column 42 can have shapes other than the illustrated U-shaped design; the legs 66 could not extend past the centerline C1 of the guide posts; and/or the bottom portion of the column 42 could have a shape or structure than that illustrated if so desired.

Figure 5:
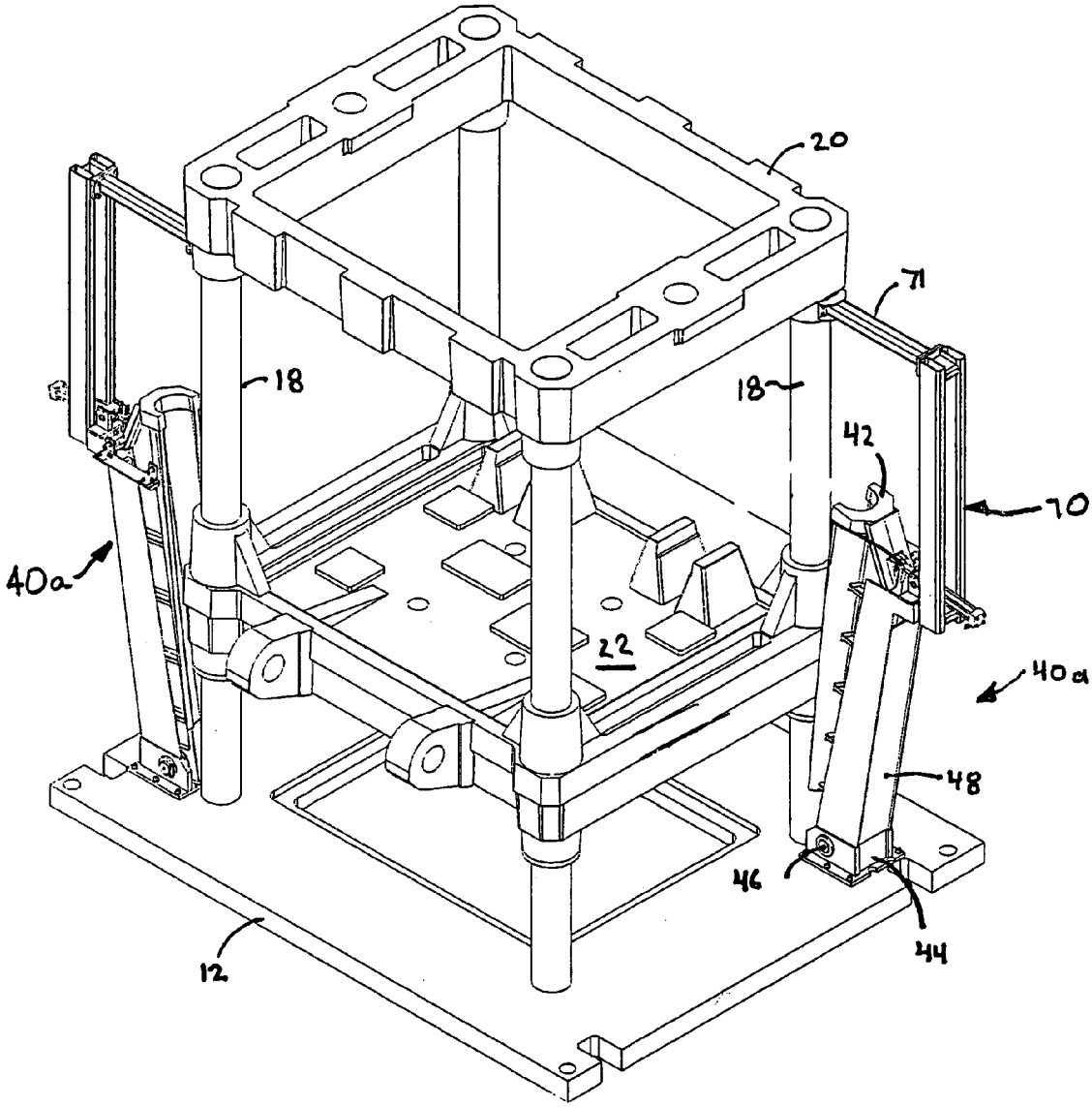
FIG. 5 is a perspective view of a die casting apparatus having a second embodiment of a safety block device in accordance with the invention, the safety block device being illustrated in a non-working position.

Referring now to FIG. 5 and using like reference numbers to indicate corresponding parts, there is illustrated a second embodiment of a safety block device, indicated generally at 40*a*, in accordance with this invention. In this embodiment the safety block device 40A includes a support frame, indicated generally at 70, that extends to the top of the die casting apparatus 10. The support frame 70 includes an extension arm 71 which is attached to the guide post 18 by suitable means.

Figure 6:
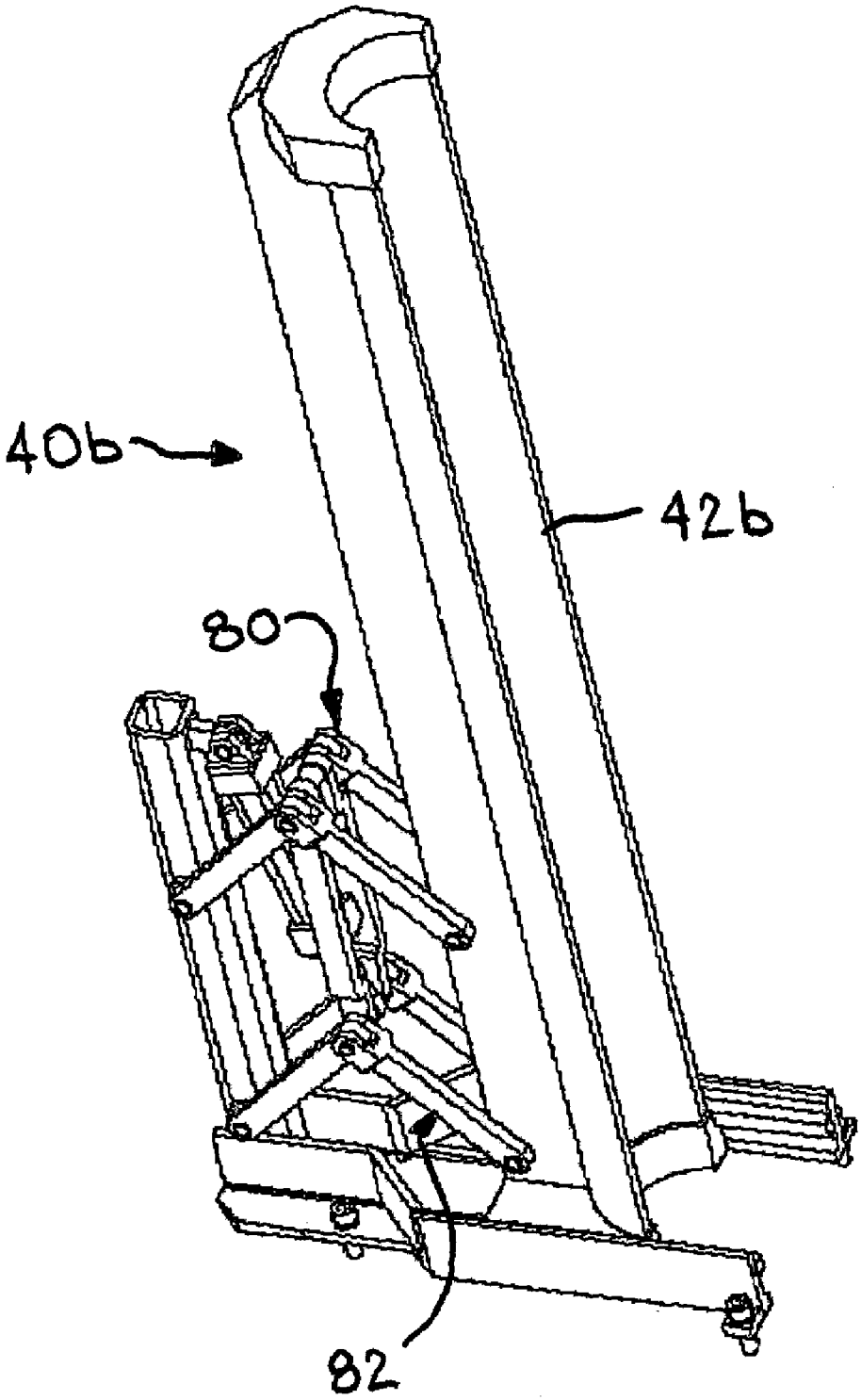
FIG. 6 is a perspective view of a third embodiment of a safety block device in accordance with the invention.

Referring now to FIG. 6 and using like reference numbers to indicate corresponding parts, there is illustrated a third embodiment of a safety block device, indicated generally at 40*b*, in accordance with the invention. In this embodiment the device 40*b* includes an upper linkage device 80 a lower linkage device 82 for selectively moving a U-shaped column 42*b* between a retracted non-working position and an extended working position.

Figure 7:
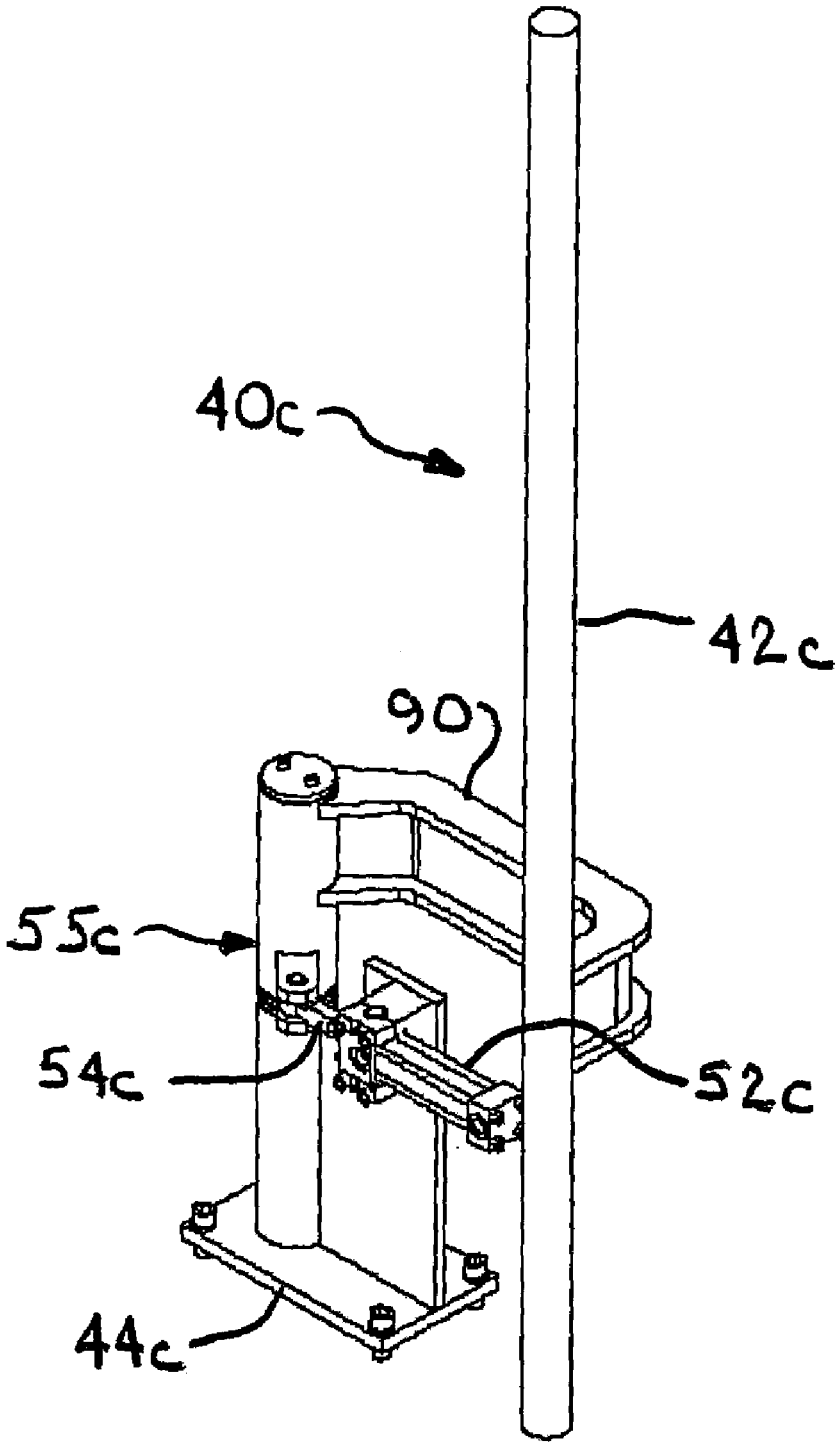
FIG. 7 is a perspective view of a fourth embodiment of a safety block device in accordance with the invention.

Referring now to FIG. 7 and using like reference numbers to indicate corresponding parts, there is illustrated a fourth embodiment of a safety block device, indicated generally at 40*c*, in accordance with the present invention. In this embodiment, the safety block device 40*c* has a base 44*c* affixed to the base plate 12 of the die casting apparatus. A pivoting arm 90 is rotatably mounted on the base 44*c*, and a column 42*c* is secured to the distal end of the pivoting arm 90 by conventional means such as welding or with fasteners. A cylinder 52*c* is mounted on the base 44*c* with a movable rod 54*c* portion thereof attached to the pivoting arm 90 at a pivot pin connection 55*c*. As the movable rod 54*c* extends outward from the cylinder 52*c*, it causes the pivoting arm 90 to swing the column 42*c* into the operating area so that the column 42*c* is positioned between the moveable platen 22 and the base plate 12.

Figure 8:
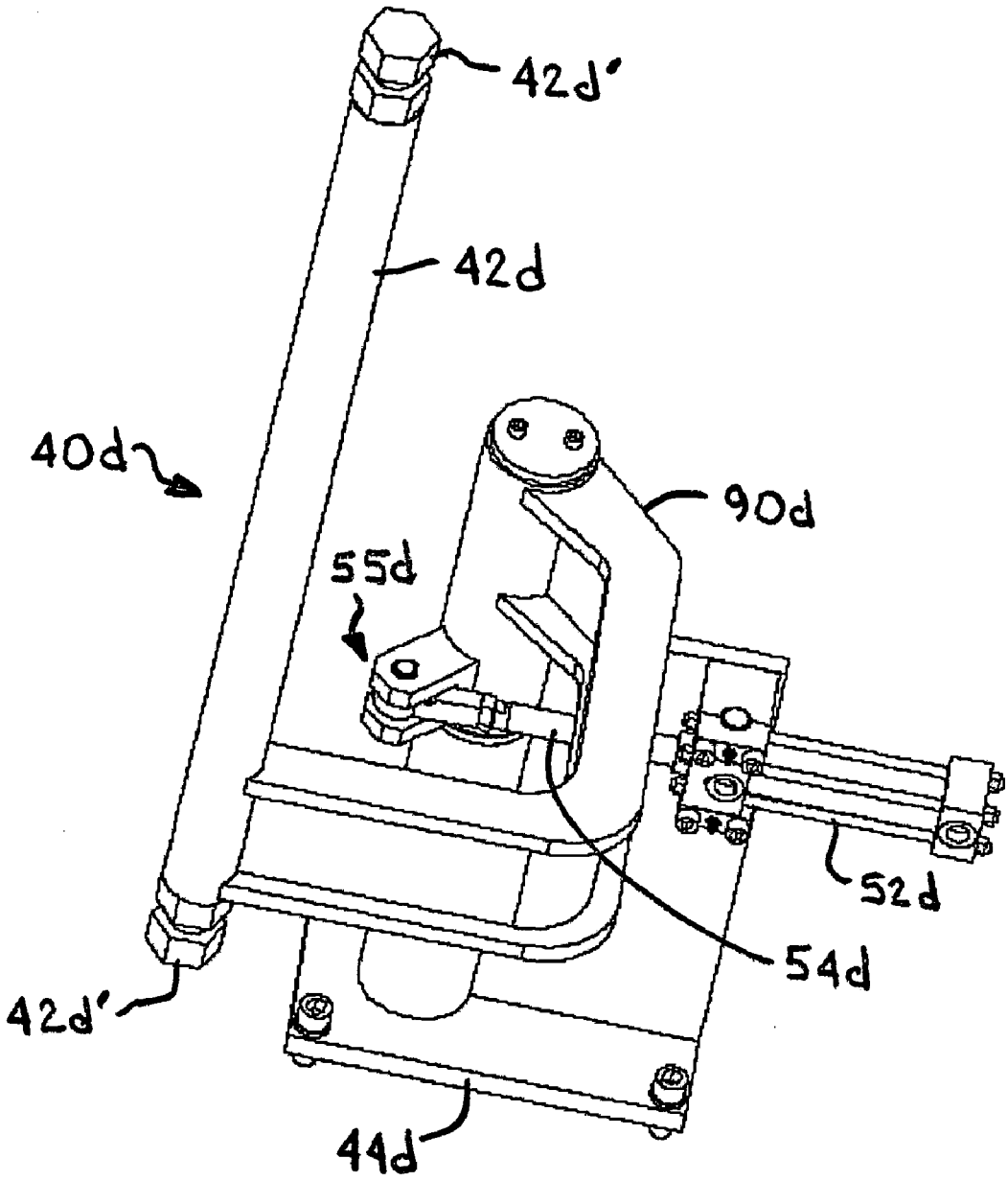
FIG. 8 is a perspective view of a fifth embodiment of a safety block device in accordance with the invention.

Referring now to FIG. 8 and using like reference numbers to indicate corresponding parts, there is illustrated a fifth embodiment of a safety block device, indicated generally at 40*d*, in accordance with the present invention. In this embodiment, the safety die block device 40*d* is similar to the safety block 40*c* shown in FIG. 7 except that the pivoting arm 90*d* is designed to swing between the cope 16 and the drag 14 rather than between the moveable platen 22 and the base plate 12 of the die casting assembly. The safety block device 40*d* has a base 44*d* affixed to the base plate 12 of the casting assembly 10 that is mounted adjacent to a guide post 18 of the casting assembly 10. A pivoting arm 90*d* is rotatably mounted onto the base 44*d*, and a column 42*d* is secured to the distal end of the pivoting arm 90*d* by conventional means such as welding or with fasteners. A cylinder 52*d* is mounted onto the base 44*d* with the movable rod 54*d* portion attached to the pivoting arm 90*d* at a pivot pin connection 55*d*. As the movable rod 54*d* extends outward from the activated cylinder 52*d*, it causes the pivoting arm 90*d* to swing the column 42*d* into the press area so that the column 42*d* rests between the movable platen 22 and the base plate 12. Also, in this embodiment, column 42*d* is provided with adjustable members 42*d*' at the opposed ends thereof to accommodate for varying distances between the cope 16 and the drag 14 which are used.

Figure 9:
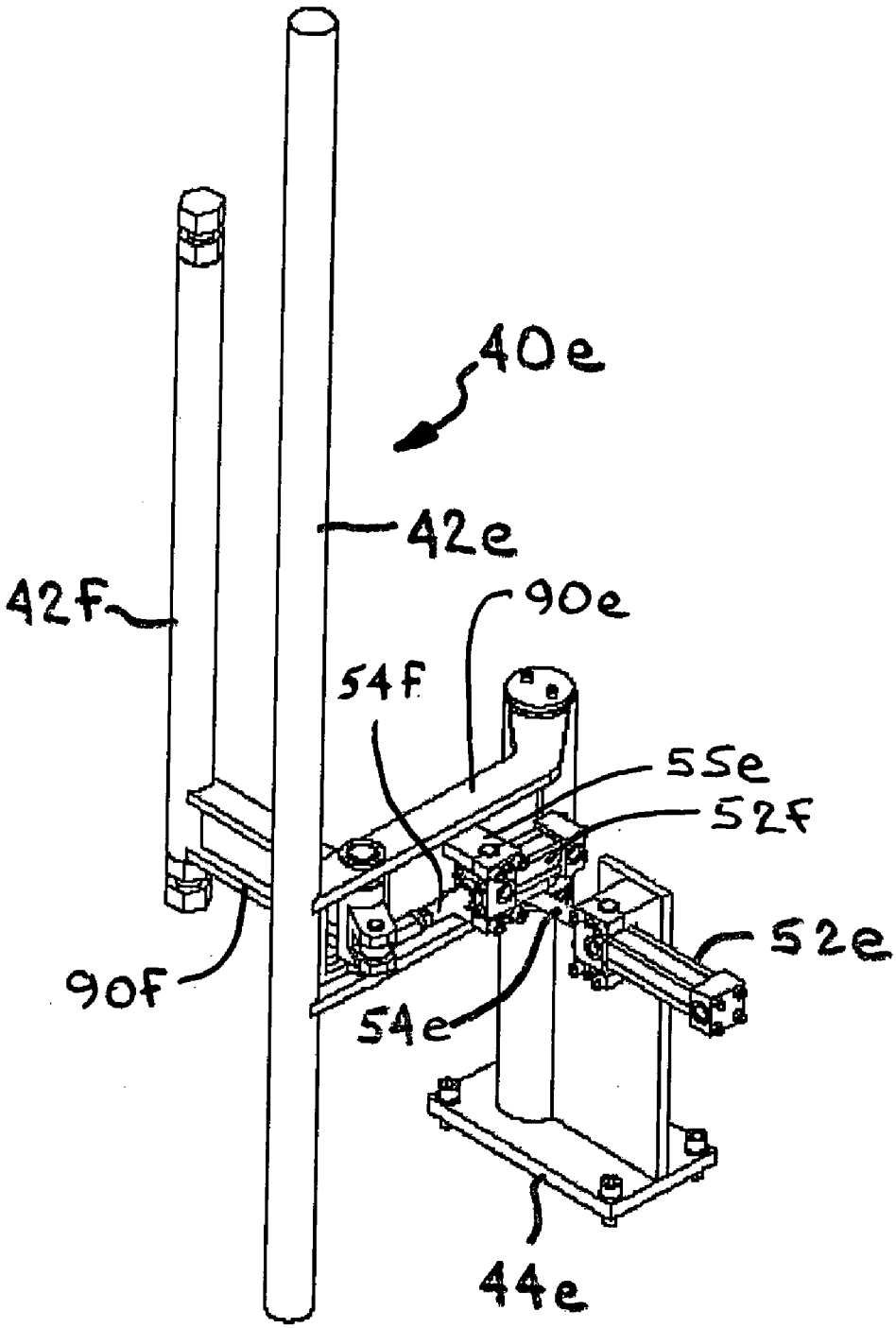
FIG. 9 is a perspective view of a sixth embodiment of a safety die block device in accordance with the invention.

Referring now to FIG. 9 and using like reference numbers to indicate corresponding parts, there is illustrated a sixth embodiment of a safety block device, indicated generally at 40*e*, in accordance with the present invention. In this embodiment the safety block device 40*e* is generally a combination of the safety blocks 40*c* and 40*d* discussed above, and it may be used to secure the movable platen 22, tilt plate 26 and cope 16 in place using a two-column system. The safety die block device 40*e* has a base 44*e* affixed to the base plate 12 of the die casting apparatus that is mounted adjacent to a guide post 18 thereof. A first pivoting arm 90*e* is rotatably mounted onto the base 44*e*, and a first column 42*e* is secured to the distal end of the first pivoting arm 90*e* by conventional means such as welding or with fasteners. A first cylinder 52*e* is mounted onto the base 44*e* with a first movable rod 54*e* portion attached to the first pivoting arm 90*e* at a pivot pin connection 55*e*. Affixed to the first pivoting arm 90*e* is a second cylinder 52*f* with a second movable rod 54*f* attached to a second pivoting arm 90*f* that is movably secured into the first pivoting arm 90*e* by a pivot pin 92. A second column 42*f* is secured to the distal end of the second pivoting arm 90*f* by conventional means such as welding or with fasteners. As the first movable rod 54*e* extends outward from the first cylinder 52*e*, it causes the first pivoting arm 90*e* to swing the first column 42*e* into the press area so that the first column 42*e* rests between the movable platen 22 and the base plate 12 to secure the movable platen 22 in place. As the second movable rod 54*f* extends outward from the second cylinder 52*f*, it causes the second pivoting arm 90*f* to swing the second column 42*f* into the press area so that the second column 42*f* rests between the cope 16 and the drag 14, thus securing the tilt plate 26 and cope 16 in place relative to the drag 14.

Figure 10:
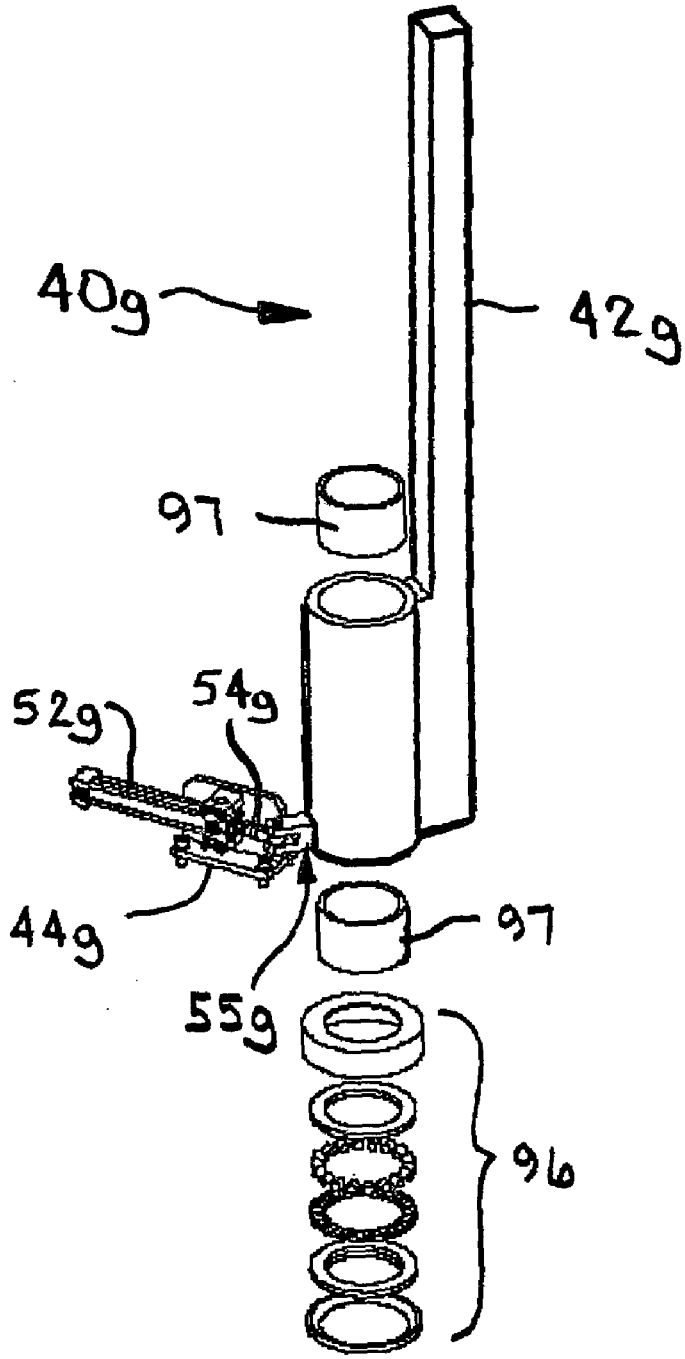
FIG. 10 is a perspective view of a seventh embodiment of a safety die block device in accordance with the invention.

Referring now to FIG. 10 and using like reference numbers to indicate corresponding parts, there is illustrated a seventh embodiment of a safety block device, indicated generally at 40*f*, in accordance with this invention. In this embodiment the safety block device 40*g* is rotatably mounted around a guide post 18 of the die casting apparatus so that the axis of rotation for the rotating column 42*g* is about the center line of the guide post 18. The safety block device 40*g* includes a column 42*g* that is a secured to a cylindrical support 48*g* rotatably oriented about the lower portion of a guide post 18.

In this embodiment, the bottom of the cylindrical support 48*g* is equipped with a bearing assembly 96 so the cylindrical support 48*g* can withstand a substantial downward thrust load, for example, of up to around 271,000 pounds. A base 44*g* attached to the base plate 12 of the casting assembly 10 supports an activated cylinder 52*g*. The movable rod 54*g* of the activated cylinder 52*g* is connected to the cylindrical support 48*g* in a pivot pin connection 55*g* so that the cylindrical support 48*g* rotates about the axis of the guide post 18 when the movable rod 54*g* is extended. As the cylindrical support 48*g* rotates about the axis of the guide post 18, the column 42*g* swings into the press area between the movable platen 22 and the base plate 12 to secure the movable platen 22 in place. Pads 97 are also installed to remove load from the thrust bearings 96 should the safety block 40*f* be activated by the movable platen 22.

Figure 11:
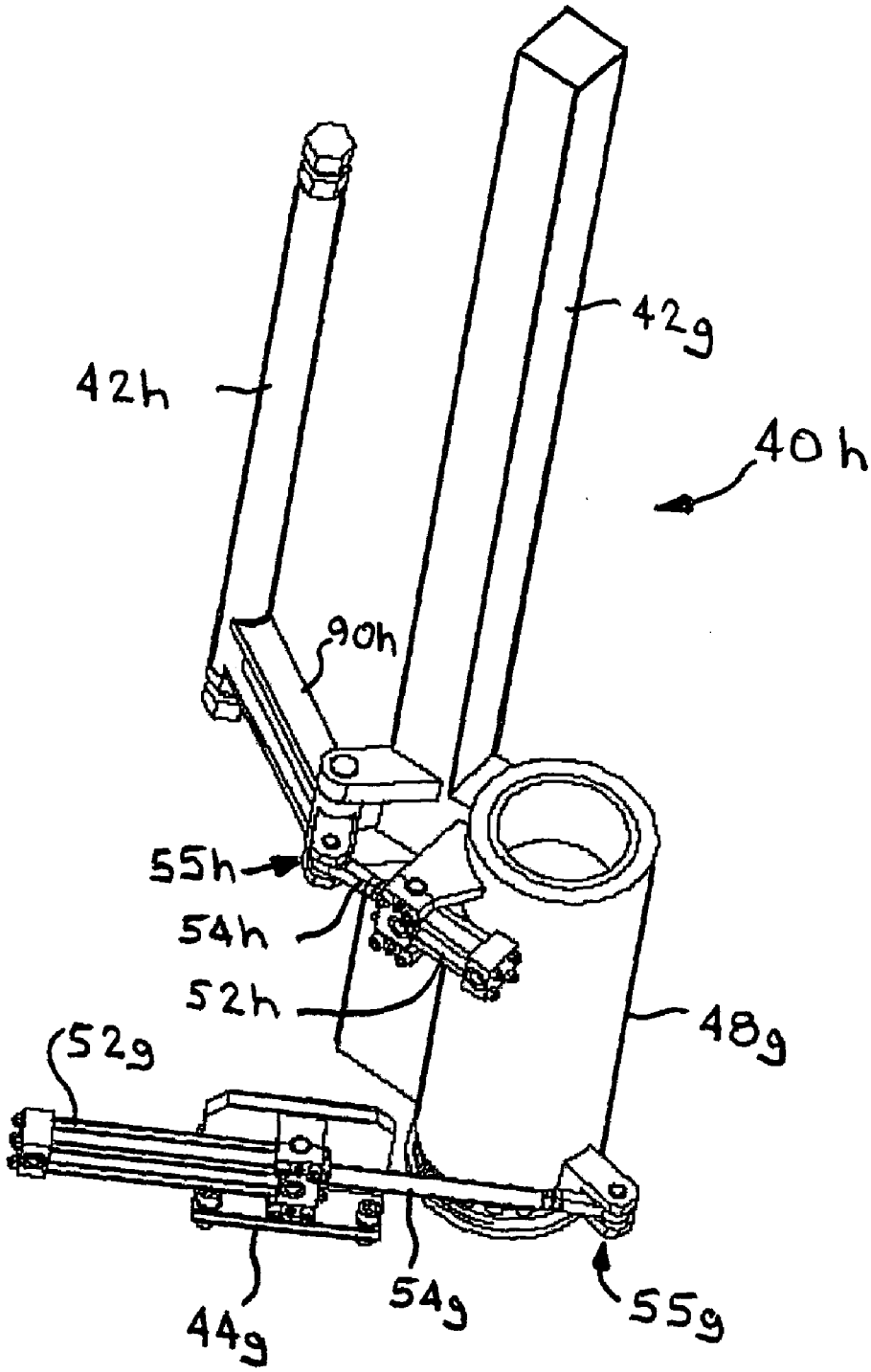
FIG. 11 is a perspective view of an eighth embodiment of a safety die block device in accordance with the invention.

Referring now to FIG. 11 and using like reference numbers to indicate corresponding parts, there is illustrated an eighth embodiment of a safety block device, indicated generally at 40*h*, in accordance with the present invention. In this embodiment, the safety block device 40*h* is generally the same as the safety block device 40*g* shown in the embodiment of FIG. 10 except that a second cylinder 52*h* with a movable rod 54*h* and pivoting arm 90*h* have been added. As the cylindrical support 48*g* rotates about the axis of the guide post 18, the column 42*g* swings between the movable platen 22 and the base plate 12 to secure the movable platen 22, while the extending movable rod 54*h* of the second cylinder 52*h* swings a pivoting arm 90*h* at a pivoting connection point 55*h* so column 42*h* swings into the press area to secure the tilt plate 26 and the cope 16 in place relative to the drag 14.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A press device comprising:

a fixed lower member for supporting at least one guide post;

a movable upper member supported by said at least guide post, said moveable upper member moveable between a raised non-working position and a lowered working position; and a safety block device supported at least by said fixed lower member, said safety block device including a generally upright column disposed adjacent said at least one guide post and moveable between a retracted non-working position, wherein said column does not support said moveable upper member, and an extended working position, wherein said column is effective to support said moveable upper member and prevent movement thereof, said column including an upper end portion and a lower end portion, said lower end portion including a generally rounded first portion and a generally second flat portion which is slightly offset with respect to said first portion whereby when said safety block device is in the extended working position, said generally flat second portion of said lower end portion of said column rests firmly on an underlying surface of either said safety block device or said fixed lower member.

2. The press device according to claim 1 wherein said column includes a bore formed therein, a pin is disposed in said bore, and said safety block device includes an actuation device for pivotally moving said column between said retracted non-working position and said extended working position.

3. The press device according to claim 1 wherein said at least one guide post defines a guide post centerline, said upper end portion of said column includes a pair of legs, and wherein when said moveable upper member is in said raised non-working position and said safety block device is in said extended working position, said legs of said column extend past said guide post centerline.

4. The press device according to claim 1 wherein said column is generally U-shaped and has an inner radius of curvature slightly larger than an outer diameter of said at least one guide post.

5. The press device according to claim 1 wherein said press device is a casting machine having four guide posts, and at least two of said four guide posts have said safety block device disposed adjacent thereto.

6. The press device according to claim 1 wherein said press device is a casting machine, said casting machine including a base plate for supporting a lower mold half, an upper mold half supported above said lower mold half.

7. The press device according to claim 1 wherein said lower end portion of said safety block device is operatively secured to said fixed lower member and said upper end portion of said safety block device is operatively secured to an upper end portion of said at least one guide post.

8. The press device according to claim 1 wherein said safety block device is automatically moveable between said retracted non-working position and said extended working position by an automatic actuation device operatively carried by said column, wherein said actuation device includes a cylinder having a movable member which is operative to pivot said column about said at least one guide post.

9. The press device according to claim 1 wherein said column extends about said at least one guide post to encompass more than 50 percent of a diameter thereof.

10. A casting machine comprising:

a base plate;

a lower mold half attached to said base plate;

a plurality of guide posts secured to and extending upwardly from said base plate to define an operating area there between;

a fixed platen supported at the top of said guide posts;

a moveable platen operatively carried by said guide posts for vertical movement thereof in said operating area;

a tilt plate operatively connected to said movable platen;

an upper mold half attached to said tilt plate; and at least one safety block device operatively secured to at least said base plate, said at least one safety block device including a generally upright column disposed adjacent a respective one of said plurality of said guide posts and moveable between a retracted non-working position, wherein said column does not support said moveable platen, and an extended working position, wherein said column is effective to support said moveable platen and prevent movement thereof, said column including an upper end portion and a lower end portion, said lower end portion including a generally rounded first portion and a generally second flat portion which is slightly offset with respect to said first portion whereby when said at least one safety block device is in the extended working position, said generally flat second portion of said lower end portion of said column rests firmly on an underlying surface of either said at least one safety block device or said base plate.

11. The casting machine according to claim 10 wherein said column includes a bore formed therethrough, a pivot pin is disposed in said bore, and said at least one safety block device further includes an actuating mechanism for pivotally moving said column between said retracted non-working position and said extended working position.

12. The casting machine device according to claim 10 wherein said respective one of said plurality of said guide posts defines a guide post centerline, said upper end portion of said column includes a pair of legs, and wherein when said moveable platen is in said raised non-working position and said at least one safety block device is in said extended working position, said legs of said column extend past said guide post centerline.

13. The casting machine according to claim 10 wherein said column is generally U-shaped and has an inner radius of curvature slightly larger than an outer diameter of said plurality of said guide posts.

14. The casting machine according to claim 10 wherein said casting machine has four guide posts, and at least two of said four guide posts have said safety block device disposed adjacent thereto.

15. The press device according to claim 10 wherein said lower end portion of said at least one safety block device is operatively secured to base plate and said upper end portion of said at least one safety block device is operatively secured to an upper end portion of said respective one of said plurality of said guide posts.

16. The press device according to claim 10 wherein said column extends about said respective one of said plurality of said posts to encompass more than 50 percent of a diameter thereof.

17. A safety block device for supporting a generally vertically movable component about a guide post of a press device, said safety block device comprising:

a generally upright column adapted to be disposed adjacent the guide post and moveable between a retracted non-working position, wherein said column does not support the moveable component, and an extended working position, wherein said column is effective to support the moveable component and prevent movement thereof, said column including an upper end portion and a lower end portion, said lower end portion including a generally rounded first portion and a generally second flat portion which is slightly offset with respect to said first portion whereby when said safety block device is in the extended working position, said generally flat second portion of said lower end portion of said column rests firmly on an underlying surface of either said safety block device or the press device.

18. The safety block device according to claim 17 wherein said column includes a bore formed therethrough, a pivot pin is disposed in said bore, and said safety block device further includes an actuating mechanism for pivotally moving said column between said retracted non-working position and said extended working position.

19. The casting machine according to claim 17 wherein said column is generally U-shaped and has an inner radius of curvature slightly larger than an outer diameter of the guide post.

* * * * *